US007883131B2

(12) United States Patent
Camp et al.

(10) Patent No.: US 7,883,131 B2
(45) Date of Patent: Feb. 8, 2011

(54) CRANE HOOK ASSEMBLIES AND METHODS OF USE

(75) Inventors: David Camp, Cokato, MN (US); Darin Young, Cokato, MN (US)

(73) Assignee: Machining and Welding by Olsen, Inc., Minneapolis, MN (US)

( * ) Notice: Subject to any disclaimer, the term of this patent is extended or adjusted under 35 U.S.C. 154(b) by 554 days.

(21) Appl. No.: 11/928,949

(22) Filed: Oct. 30, 2007

(65) Prior Publication Data

US 2009/0108604 A1 Apr. 30, 2009

(51) Int. Cl.
*B66C 1/66* (2006.01)

(52) U.S. Cl. ..... 294/82.23; 294/67.22; 414/910

(58) Field of Classification Search ..... 294/67.22, 294/67.3, 67.33, 81.5, 81.56, 82.13, 82.17, 294/82.23; 414/910
See application file for complete search history.

(56) References Cited

U.S. PATENT DOCUMENTS

| | | | | | |
|---|---|---|---|---|---|
| 597,438 | A | | 1/1898 | Schilling | |
| 859,513 | A | * | 7/1907 | Paige | 254/93 R |
| 1,591,248 | A | | 7/1926 | Tracy | |
| 2,333,925 | A | * | 11/1943 | Grossett | 294/82.23 |
| 2,441,026 | A | | 5/1948 | Long | |
| 2,816,792 | A | | 12/1957 | Dixon | |
| 3,343,861 | A | | 9/1967 | Sinicki | |
| 3,517,959 | A | | 6/1970 | Ferguson | |
| 3,749,437 | A | | 7/1973 | Lynn | |
| 4,030,747 | A | | 6/1977 | Morse et al. | |
| 4,193,627 | A | | 3/1980 | Cranston et al. | |
| 4,515,522 | A | | 5/1985 | Sonerud | |
| RE32,532 | E | | 10/1987 | Sonerud | |
| 4,832,558 | A | * | 5/1989 | Tauscheck | 414/798.9 |
| 5,205,599 | A | | 4/1993 | Wassmer et al. | |
| 5,445,426 | A | | 8/1995 | Sorensen | |
| 5,707,168 | A | | 1/1998 | Sharon | |
| 6,536,591 | B2 | | 3/2003 | Huang et al. | |
| 7,134,701 | B1 | | 11/2006 | Ronning | |
| 2004/0217610 | A1 | | 11/2004 | Hollman et al. | |
| 2006/0055188 | A1 | | 3/2006 | Koch | |

* cited by examiner

*Primary Examiner*—Dean J Kramer
(74) *Attorney, Agent, or Firm*—Moore & Hansen, PLLP

(57) ABSTRACT

A crane hook assembly and methods of use for safely lifting large conduits, such as wind generator tower sections. The hook assembly includes a steel frame member and a support member forwardly extending from the front surface of the frame member. The support member cooperates with the frame member to engage and retain an annular flange of the tower section. The hook assembly is secured onto the tower section with a securing mechanism, preferably using a rack and pinion gear assembly to actuate a locking pin. The sliding, retractable, locking pin may be actuated such that it is movable between an unlocked position and a locking position, such that the locking pin is positioned horizontally over the tower section when in the locked position and the locking pin is fully retracted from the front surface when the locking pin is in the unlocked position.

28 Claims, 5 Drawing Sheets

CRANE HOOK ASSEMBLIES AND METHODS OF USE

BACKGROUND

1. Field of the Invention

The invention relates generally to a crane hook assembly for lifting heavy, elongated loads and to methods for safely lifting such loads. Particularly, the present invention relates to a specialized crane hook assembly for lifting the elongated, heavy sections, which when assembled form the high support tower for a wind powered electrical generator.

2. Description of the Related Art

Wind powered generators are mounted at the top of high support towers that are commonly over two hundred feet high so as to catch the high surface winds. The towers are installed in open country, usually far distant from heavily populated areas, and all the components of the generator and tower must be transported to the site by rail or large truck and there unloaded by cranes equipped for the unloading process. A large, high capacity generator unit is typically mounted on the top of such a tower, approximately 240 feet above ground level. The typical tower is formed from three long cylindrical tower sections, each section having a length of about 82 feet. The lowest section is quite massive with a fourteen foot diameter and can weigh about eighty tons. The middle section is slightly less in weight and has some taper from bottom to top. The upper section tapers further to a final diameter of about 9 feet at its upper end. Typically, each tower section has an annular mounting flange at each end, with the flange extending radially inwardly and outwardly from the cylindrical tower section wall at a right angle to the tower section's central longitudinal axis. Each annular flange has a multiplicity of bolt apertures positioned about its outer perimeter, and these apertures align with the apertures of an adjoining tower section's flange to allow adjacent tower sections to be bolted together end-to-end when the tower is erected at the construction site.

Each of the three tower sections is transported to the tower construction site on separate semi-trucks or rail cars, and the sections are delivered on a rigorous schedule which assures that all the trucks or rail cars will be available for prompt unloading so the trucks or rail cars can return at once to normal service. Because of their great size, it is usually necessary to lift each of the tower sections from the truck bed or rail car using two separate cranes, one being positioned at each end of the tower section.

Previous devices and methods for lifting and unloading the tower sections have utilized steel or nylon web slings positioned around the outer periphery of the tower section near each end of the tower. Another known hook assembly utilizes a pair of crane hook assemblies, wherein a hook assembly is bolted to the flanges at each end of the tower section using a multiplicity of bolts and nuts so as to provide a relatively fail safe engagement. Additional known crane hook assemblies were developed with structure which engaged the inner circumference of the annular flange at each end of the tower section.

The present invention addresses limitations associated with the prior art.

SUMMARY OF THE INVENTION

The present invention provides a crane hook assembly and method of use for static lifting of large, heavy conduits, such as wind generator tower sections. The crane hook assembly of the present invention can be used to more safely lift such tower sections and to do so without scratching or damaging areas of the tower section that will be visible once the tower is assembled.

The preferred crane hook assembly includes an extremely heavy, rigid, upright, steel frame member which has an attachment aperture that can be used to connect the crane hook assembly to a crane. The crane hook assembly additionally includes a forwardly extending support member positioned at the bottom of the front face of the frame member. The support member cooperates with the frame member to engage and retain an annular flange of the tower section. The crane hook assembly is safely secured onto the tower section with a securing mechanism, preferably utilizing a rack and pinion gear assembly for actuating a locking pin. The sliding, retractable, locking pin may be actuated such that the locking pin is movable between a locking position, wherein the locking pin is positioned horizontally over the tower section flange, and an unlocked position, wherein the locking pin is fully retracted from the front face. Because the locking pin can be fully retracted from the front face, an unobstructed entry zone can be formed such that the tower section can easily be positioned within the entry zone without damaging visible areas of the tower section.

Preferably, to use the crane hook assembly of the present invention for a static lift of a tower segment, the crane hook assembly is first shackled to a crane through the attachment aperture, and then the crane hook assembly is positioned with the front face of the frame member bearing against the flat outer surface of the annular flange at each end of the tower section. During this positioning, the support member partially extends within the open end of the tower section such that the annular flange slips between the front face of the frame member and the support member when the crane hook assembly is raised. This positioning may be performed without the need for human hands to be in close physical proximity to the crane hook assembly, which greatly increases the safety of the process as compared to known devices.

Then, to secure the crane hook assembly to the tower section, the locking pin is actuated by an operator standing on the ground and away from the tower section and hook. Preferably, the operator uses an elongated wrench to move the locking pin outwardly from the frame member to position it over the circular outer edge of the annular flange of the tower section to secure the tower section to the crane hook assembly and preventing it from inadvertently slipping therefrom. It should also be noted that during this lifting process, only the inner circumference and mating face of the annular flange of the tower section is in contact with the crane hook assembly, and thus if any scratching of the tower flange occurs, such scratching will be applied only to parts of the flange that are inside the tower and will not be visible when the tower is erected.

These and various other advantages and features of novelty which characterize the present invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described a preferred embodiment of the present invention.

DETAILED DESCRIPTION OF THE PREFERRED EMBODIMENTS

The preferred embodiments of the present invention are illustrated in FIGS. 1-12. A crane hook assembly 10 of the present invention can be used in static lifts of conduits 110, such as wind tower generator sections including an elongated body 112, two open ends 114*a* and 114*b* each circumscribed by an annular flange 116*a* and 116*b*, respectively. Each annular flange 116*a*, 116*b* has a width W and includes a circular outer edge 118*a*, 118*b* respectively and a circular inner edge 120*a*, 120*b* (respectively FIGS. 1 and 9). It is noted that for each open end, the outer edge can have generally the same diameter as the conduit at the end of the tower section, or the outer edge can extend beyond the conduit depending on the connection required. The present invention can be used to safely lift tower sections having either type of outer edge without damaging the visible surfaces of the tower section.

Figure 1:
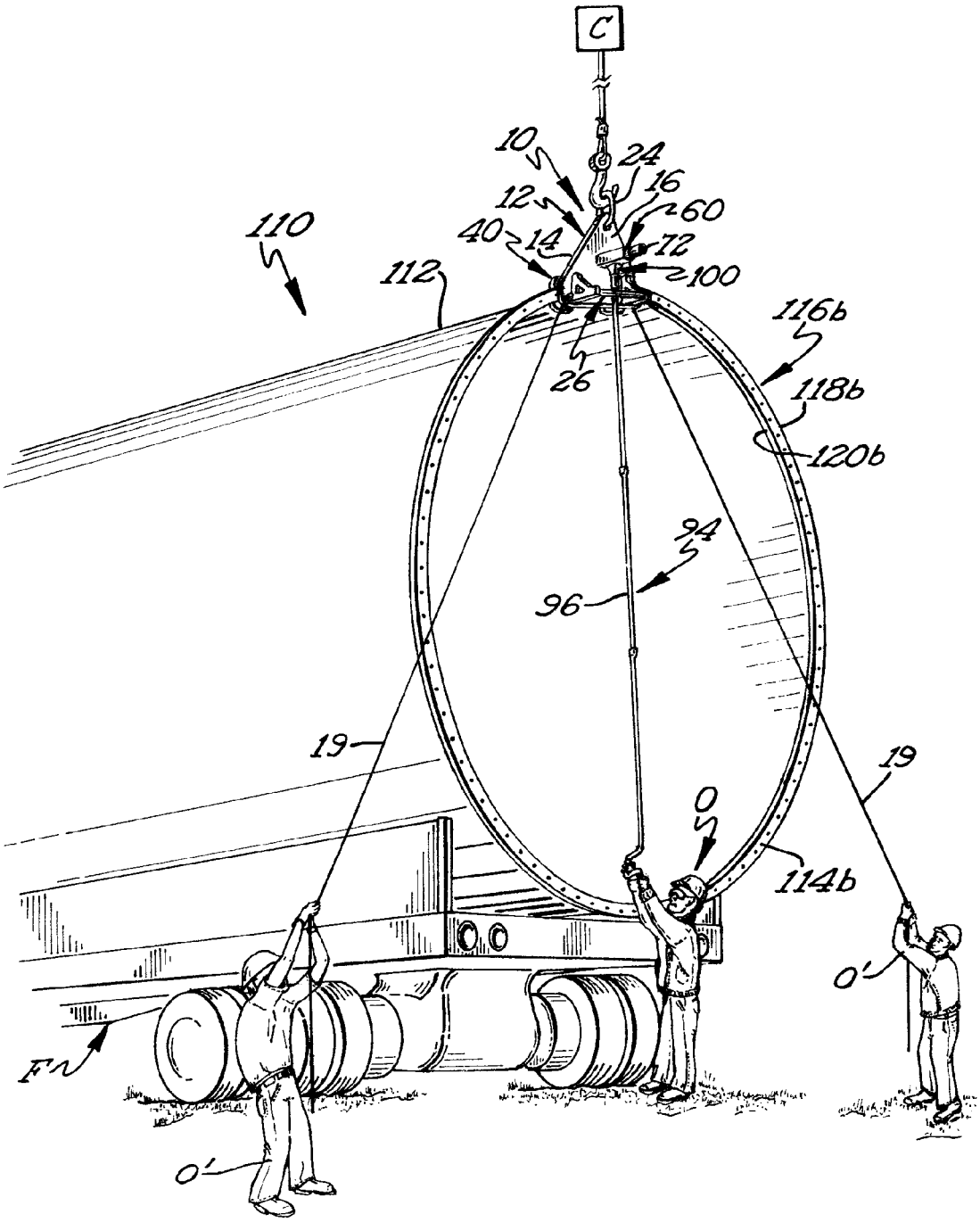
FIG. 1 is a perspective view of a crane hook assembly showing operators aligning an embodiment of the crane hook assembly with an end flange of a tower section prior to lifting and unloading the tower section from a flatbed trailer and illustrating how the workmen can safely actuate the locking pin from a distance.
Figure 2:
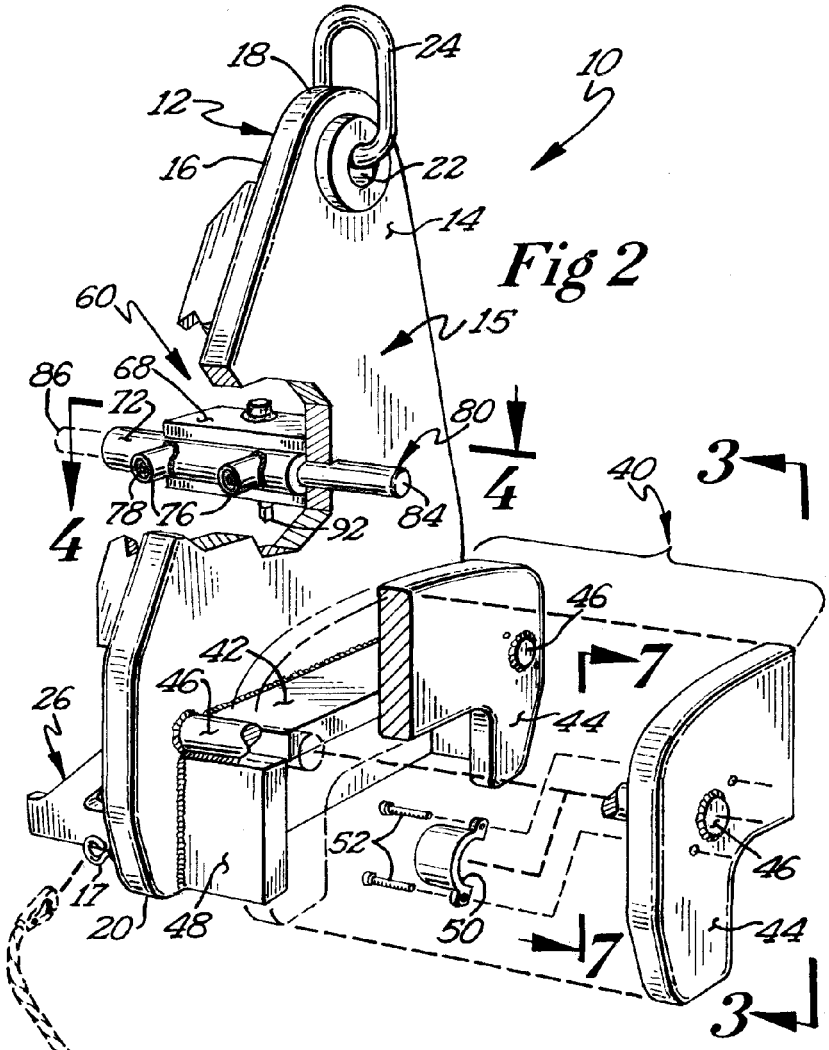
FIG. 2 is a front perspective view of the crane hook assembly with portions of the assembly partially cutaway and partially exploded.
Figures 8, 9, 10:
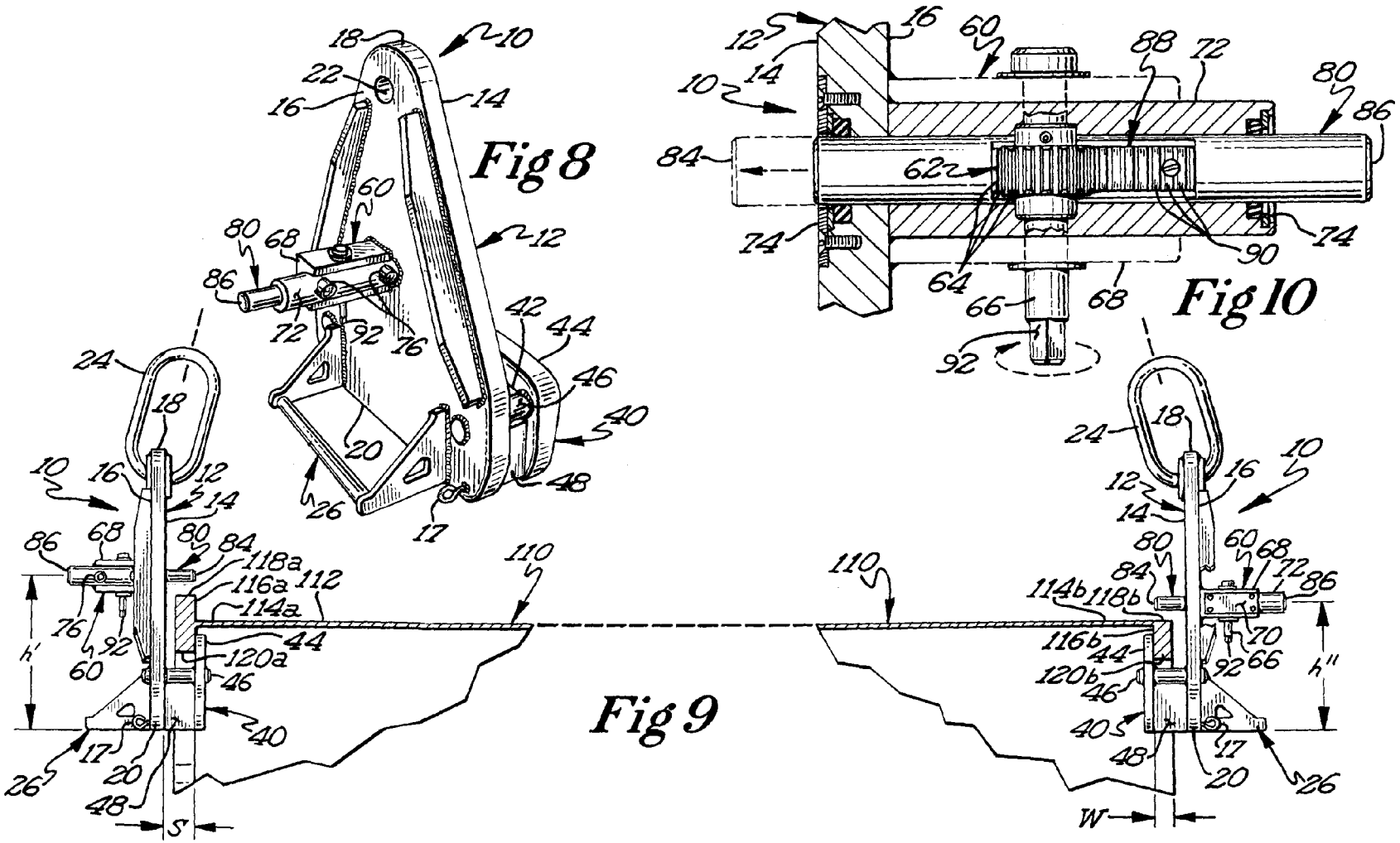
FIG. 8 is a perspective rear view of the crane hook assembly of FIG. 1 showing the locking pin in retracted position.
FIG. 9 is a view of two crane hook assemblies embodying the invention and in use at opposite ends of a tower section to lift the tower section with a shackle (the shackle shown enlarged for clarity)
FIG. 10 is a partial, side view of the rack and pinion system similar to that of FIG. 5, wherein the locking pin is shown in a fully retracted position in solid line and in extended locking position in phantom.
Figure 11:
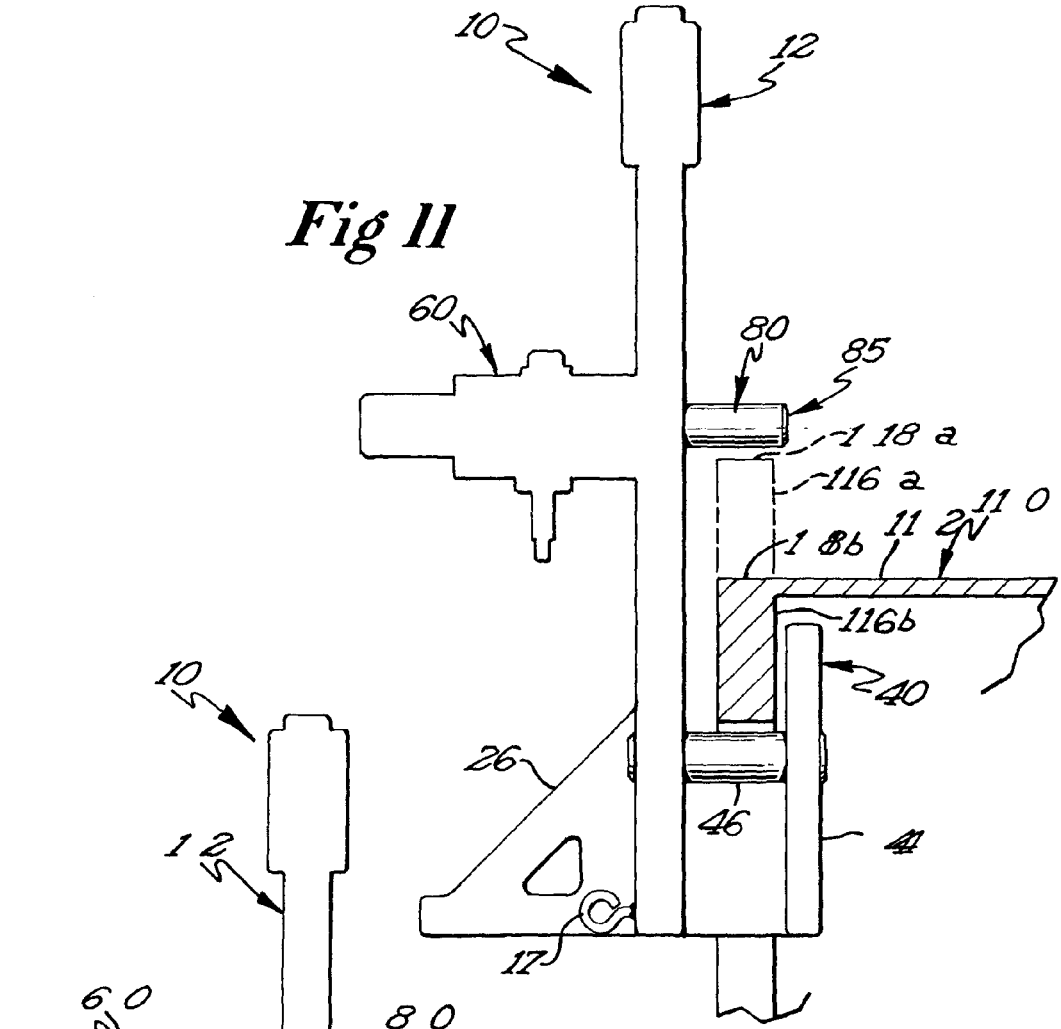
FIG. 11 is a partial, cross-sectional view of the crane hook assembly of FIG. 8 operatively secured to the tower section flange.

Now referring to FIGS. 1, 2 and 8, the preferred crane hook assembly 10 includes a frame member 12 which has front and rear faces or surfaces 14, 16, the frame member having a top and a bottom 18, 20, respectively and a shackle aperture 22 extending between the surfaces 14 and 16 that can be used to connect the crane hook assembly to the shackle 24 of a crane C (best shown enlarged in FIG. 9 for clarity). Because the crane hook assembly 10 of the present invention is particularly useful in lifting extremely heavy objects, it is preferred that the frame member 12 be formed from very strong and rigid steel.

Figure 3:
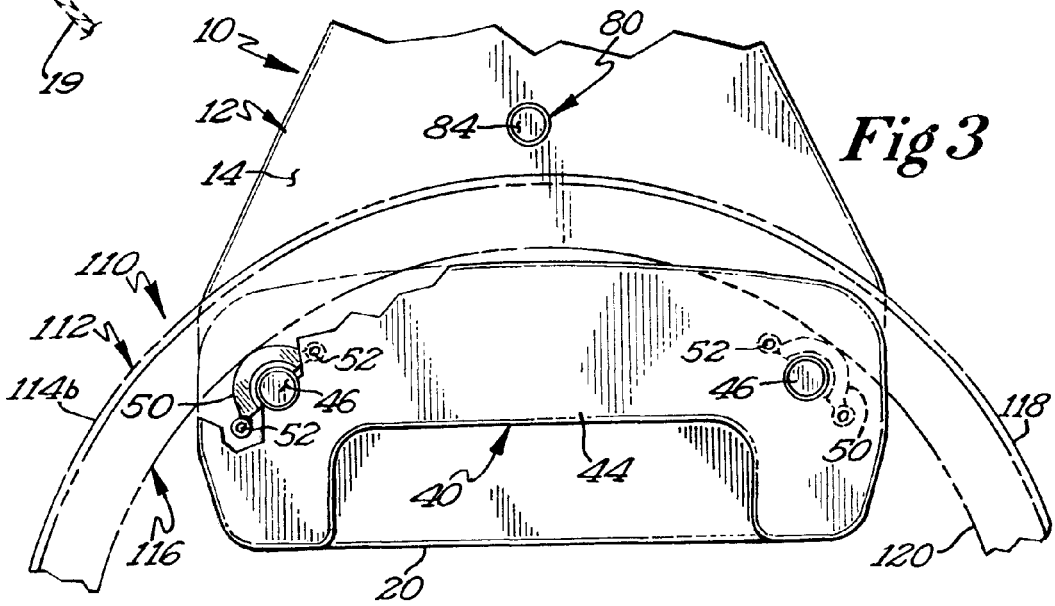
FIG. 3 is a front elevation view of the lower part of the crane hook assembly of FIG. 2 as viewed along viewing line 3-3 with a portion of the assembly cut away to illustrate the manner in which the flange of a generator tower section is supported by the assembly.

As best shown in FIGS. 2 and 3, the preferred frame member 12 further includes a support member 40 adjacent the bottom 20 of the crane hook assembly 10. The preferred support member 40 includes a base member 42 and a retention barrier 44 that is generally parallel to the front surface 14. The base member 42 utilizes two shafts or dowels 46 which extend between the retention barrier 44 and the front surface 14 and support the tower section 110 as it is being lifted. The base member 42 further includes two shaft supports 48 that reinforce and support the dowels 46. In preferred embodiments, the frame member 12 includes at least one support stand 26 arranged and configured such that the support member 40 is counterbalanced and the frame member 12 can be positioned upright on the ground for easy attachment to the crane C.

Figure 4:
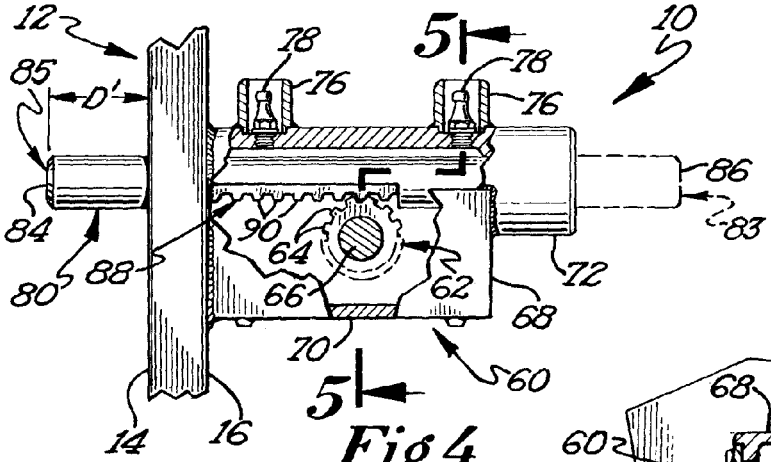
FIG. 4 is a partial, cross-sectional side view of the gear system used with the crane hook assembly of FIG. 2 taken along cutting plane 4-4 and with portions cut away to better illustrate the gear system.
Figure 5:
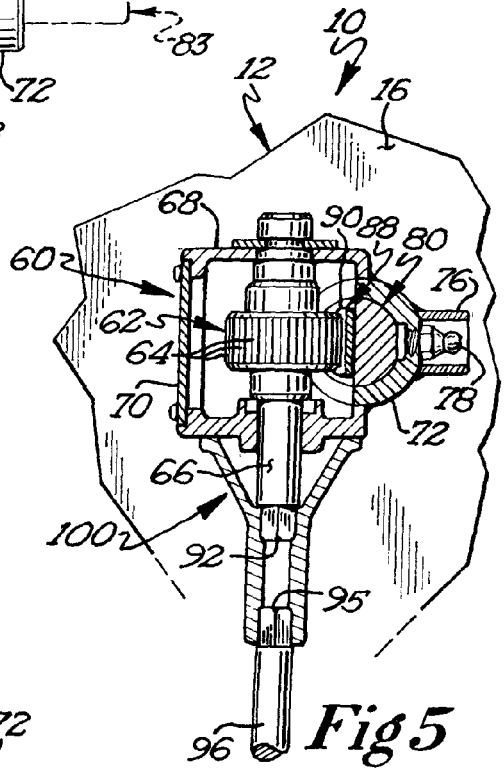
FIG. 5 is a cross-sectional top view of the gear system of FIG. 4 taken along cutting plane 5-5.
Figure 6:
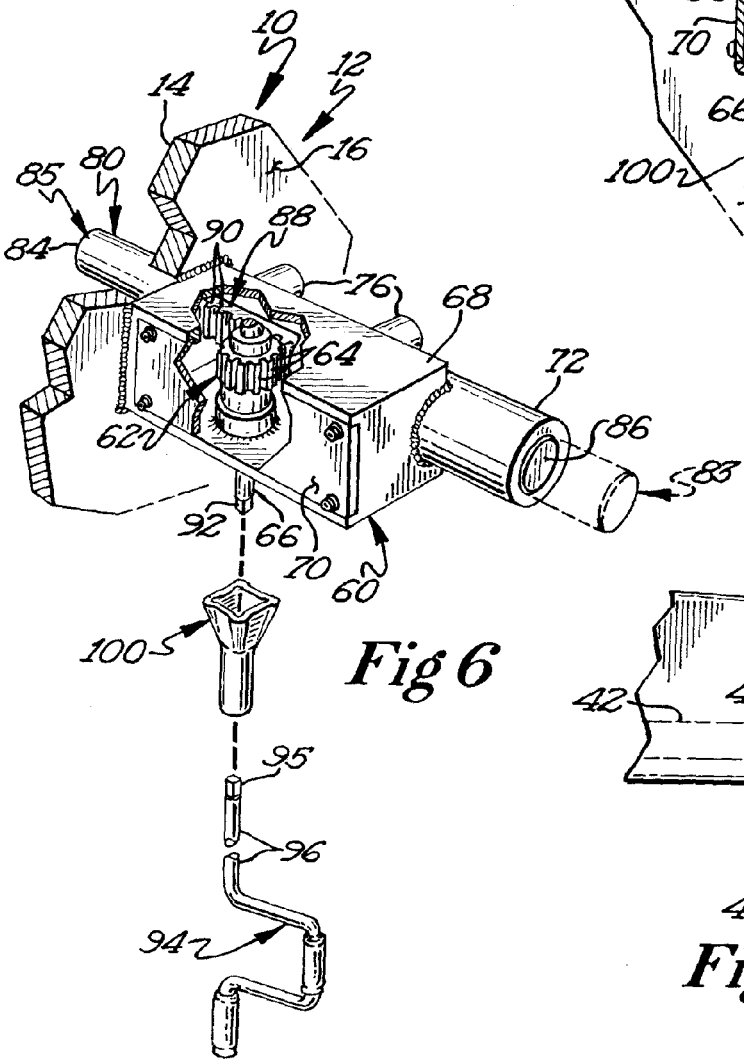
FIG. 6 is a cutaway perspective rear view of the gear system of FIG. 2 taken from the rear and side of the crane hook assembly and showing the locking pin in extended locking and retracted storage positions and illustrating an actuation tool for use in moving the locking pin.
Figure 7:
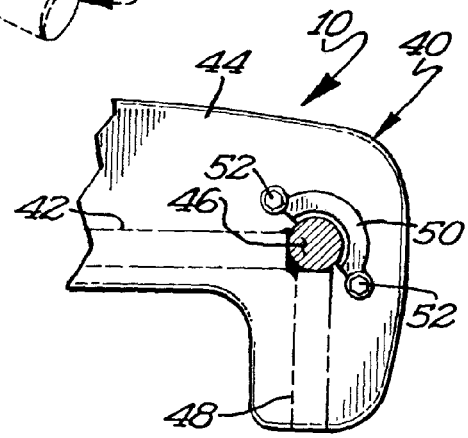
FIG. 7 is a partial, cross-sectional view of the support member of FIG. 2 taken along cutting plane 7-7.

The crane hook assembly 10 can be secured to the tower section 110 with a securing mechanism 60, preferably a rack and pinion gear assembly, as best illustrated in FIGS. 4-6. If it were not for the securing mechanism 60 of the present invention, the crane hook assembly 10 would not prevent the crane hook assembly 10 from slipping off the tower section 110 during unexpected lift conditions. Because workmen are often in constant proximity to these large, heavy tower sections 110, it is highly preferred that the crane hook assembly 10 be structurally formed to assure that the crane hook assembly 10 cannot accidentally disengage from the tower section 110 being lifted.

As shown, the rack and pinion gear assembly 60 includes a rotatably mounted pinion 62 encased by a housing 68 and a preferably cylindrical cross section locking pin 80 having first and second ends 84, 86 and a rack 88 therebetween. The housing 68 is positioned on the rear surface 16 of the frame member 12 and, in preferred embodiments, includes a lock pin guide 72 extending along the length of the housing to slideably support the locking pin 80. The preferred housing 68 additionally includes protective piping 76 to protect grease fittings 78.

The pinion 62 has a set of pinion teeth 64 that engage a second set of teeth 90 positioned along the length of the rack 88. As the pinion 62 rotates, the pinion teeth 64 engage the rack teeth 90 and correspondingly move the locking pin 80 horizontally. The sliding, retractable, locking pin 80 may be positioned in either a locked or load carrying position 85, wherein the locking pin 80 is positioned over the flange 116*a*, 116*b* and an unlocked position 83, wherein the locking pin 80 is fully retracted into the front surface 14. In preferred embodiments, the rack and pinion gear assembly 60 includes a downwardly facing actuator 92, the actuator 92 controlling the movement of the pinion teeth 64.

Many known devices for moving large conduits, such as steel or nylon web slings, cause serious scratching and marring of the exterior surface and paint on the tower section and created further refinishing expense and delays in erecting the tower while the surface was refinished. This touch-up work is time consuming, difficult and costly since the refinishing work is often located on portions of the large diameter sections up to fourteen feet off the ground and in other cases on portions which are marginally accessible without moving the heavy sections. The crane hook assembly of the present invention eliminates damage to visible surfaces of the tower section when the crane hook assembly is used properly. One of the damage prevention features includes the locking pin 80 being fully retractable so that it does not protrude from the front surface 14. When the locking pin 80 is fully retracted, an unobstructed entry zone is formed such that the crane hook assembly 10 can be brought to the tower section 110 and the tower flange received into the unobstructed entry zone without the scratching or damaging of visible surfaces of the tower section. The preferred unobstructed entry zone includes a volume between a generally flat portion 15 of the front surface 14 and retention barrier 44 which extends from the top of the support member 40 to the shackle aperture 22 when the locking pin 80 is fully retracted. To aid in aligning the tower section 110 within the entry zone, the preferred rear surface 16 of the frame member 12 includes one attachment element 17 proximate each support stand 26. A rope 19 can be secured to each of the attachment elements 17, respectively, so that additional operators O' can assist in the lateral movement of the crane hook assembly 10 during the tower attachment process (see, in particular, FIG. 1).

Now referring, in particular to FIG. 10. In preferred embodiments, the rack and pinion gear assembly 60 includes a seal or gasket 74 on either side of the locking pin 80 to prevent dirt, debris and the like from getting into the housing 68. Additionally, in preferred embodiments, the housing 68 includes a removable cover 70 such that components of the rack and pinion gear assembly 60 may be easily accessed for maintenance, cleaning and such.

Referring now to FIGS. 1 and 6, preferably, an elongated wrench 94 is used to control a downwardly facing actuator 92 of the rack and pinion gear assembly 60 such that a worker can easily adjust the position of the locking pin 80 from a safe distance. The elongated wrench 94 includes a crank shaft 96 having a socket 95 on one end.

In the most preferred embodiments, the elongated wrench 94 further includes a funnel-shaped guide 100 proximate the socket 95 to increase the ease in which the socket 95 be operatively connected to the actuator 92. The preferred funnel shaped guide 100 is secured to or integrally formed with the crank shaft 96 or the socket 95 such that the operator O can easily align the socket 95 with the actuator 92 without risk of the funnel shaped guide 100 falling off the crank shaft 96. The socket 95 and actuator 92 can, for example, have a hexagonal, square or triangular shape. The shape of the socket 95 corresponds to the shape of the actuator 92 such that the actuator 92 can be engaged and operatively adjusted by engaging the socket 95 with the actuator 92 and rotating the socket such that the actuator correspondingly rotates.

Referring now to FIGS. 3 and 9, various sized conduits or towers sections 110 will require locking pins at various heights h', h" from the bottom 20 of the frame member 12 to ensure that the flange 116*a* or 116*b* cannot become disengaged from the crane hook assembly 10. In alternate embodiments of the present invention, the diameter of the shafts 46 may be enlarged to accommodate different sized tower sections instead of having to adjust the height of the locking pin 80. To enlarge the diameter of the shaft 46, a shim 50 can be secured to the shaft 46. As best shown in FIGS. 2 and 3, the preferred shim 50 is semi-cylindrical and bolts 52 can be used to secure the shim 50 to the shaft 46, thus raising the point where the tower 110 contacts the support member 40 and bringing the outer edge 118*a* or 118*b* closer to the locking pin 80.

Referring now in particular to FIGS. 1 and 9, in operation, the crane hook assembly 10 is first shackled to a crane C through the shackle aperture 22. The preferred frame member 12 additionally includes a support stand 26 extending from the rear surface 16 that acts to counterweight the support member 40 so that the crane hook assembly 10 sits upright while the crane hook assembly 10 is being shackled to the crane C. As previously mentioned, the rear surface 16 further includes one or more attachment elements 17 that can be secured to respective ropes 19. Each rope 19 can be used by a secondary operator O' to further aid in positioning crane hook assembly 10 relative to the tower section 110. To lift the tower section 110 off of a flatbed trailer F, one crane hook assembly 10 is positioned with the front surface 14 of the frame member 12 bearing against the flat outer surface 114*a*, 114*b* of the annular flange 116*a*, 116*b* of each end of the tower section 110. During this positioning, the base member 42 and retention barrier 44 will extend within the open end of the tower section 110 such that the annular flange 116*a*, 116*b* of the tower section 110 slips between the front surface 14 of the frame member 12 and the upright retention barrier 44 as the crane hook assembly 10 is raised against the flange of the tower section 110 (FIG. 1). As best illustrated in FIG. 1, the crane hook assembly 10 can be secured to the tower section 110 with all operators O, O' at a safe distance from the crane hook assembly 10.

As the crane hook assembly 10 is raised by the crane C, the circular inner circumference 120*a*, 120*b* of the annular flange 116*a-b* contacts and bears against the shafts 46. This alignment can be established without the need for human hands to physically contact the crane hook assembly 10, which further increases the safety of the process.

To secure the crane hook assembly 10 in place, the locking pin 80 is then actuated by the main operator O, preferably with an elongated wrench 94, to move the locking pin 80 outwardly from the front surface 14 to locked position 85 over the circular outer edge 118*a*, 118*b* of the annular flange 116*a*, 116*b* of the tower section 110, securing the tower section 110 to the crane hook assembly 10 and preventing it from inadvertently slipping therefrom. In preferred embodiments, the locking pin 80 is configured and arranged such that in locked position it will be spaced about one inch above the outer edge 118*a*, 118*b* of the annular flange 116*a*, 116*b* when in a locking position and the support member 40 is preferably arranged and configured to have a span S such that there is at least about 0.5-1.0 inch clearance on both sides of the annular flange 116*a*, 116*b*. It should be noted that during this lifting process, only the circular inner edge 120*a*, 120*b* of the annular flange 116*a*, 116*b* is in contact with the crane hook assembly 10, and thus, if any scratching of the annular flange occurs, such scratching will be applied only to parts of the annular flange that are inside the tower and will not be visible when the tower is erected.

In order to safely secure the tower section flange 116*a*, 116*b* to the crane hook assembly, the securing mechanism 60 must be arranged and configured such that the locking pin 80 will prevent the tower section flange 116*a*, 116*b* from disengaging from the crane hook assembly 10 while in the secured position while still clearing the tower section flange 116*a*, 116*b* to prevent damage to the visible surfaces under normal operating conditions. As further illustrated in FIGS. 11-12, the locking pin 80 is preferably arranged and configured such that it moves perpendicular to the frame member 12.

Figure 12:
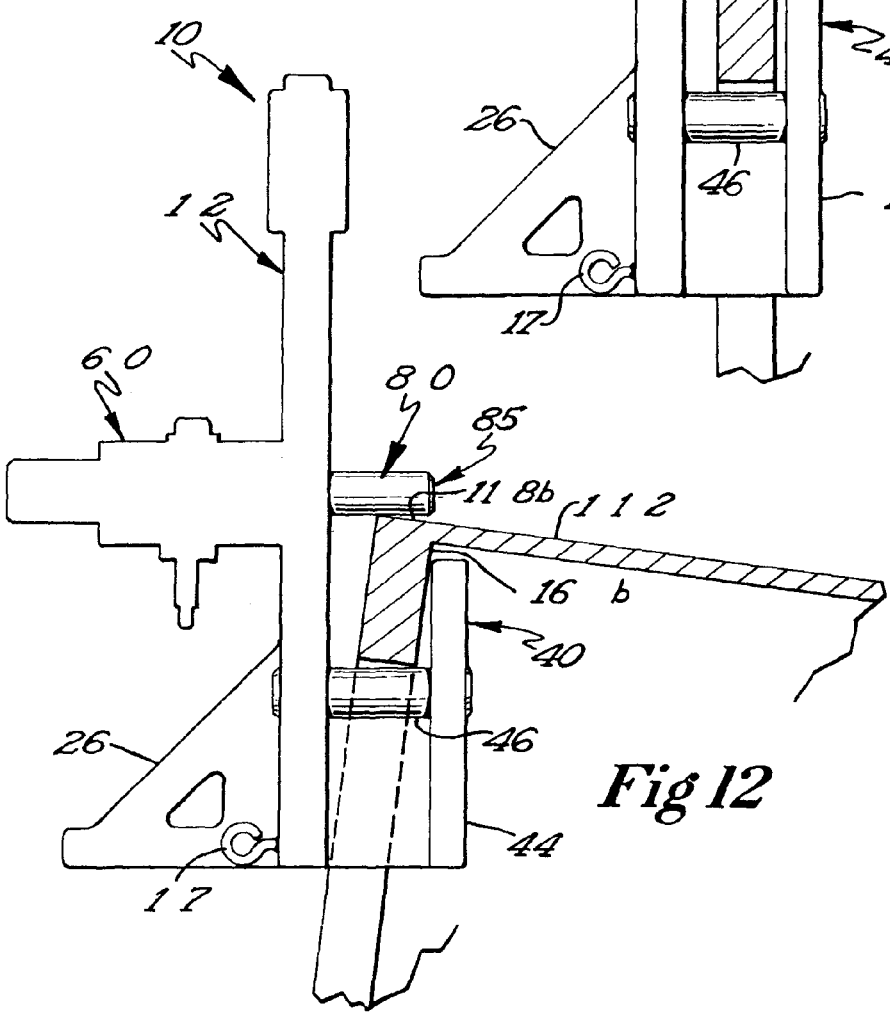
FIG. 12 is a partial, cross-sectional view, similar to that of FIG. 11, illustrating the locking pin preventing the tower section flange from becoming disengaged from the crane hook assembly when, for example, the tower section is lifted with two cranes at an uneven rate.

FIG. 12 illustrates a scenario wherein, while lifting the tower section 110 (as shown in FIG. 9), one end of the tower section has been lowered too quickly such that the opposite end of the tower section 110 tilts upwardly and could, under extreme conditions, disengage from the crane hook assembly 10 if it were not for the securing mechanism 60. As illustrated, when the tower section 110 tilts, the flange 116*b*, in this scenario, tilts against the retention barrier 44 and upwardly against the locking pin 80. Preferably, the locking pin 80 is cylindrical such that the surface area of contact between this locking pin 80 and the flange 116*b* in this scenario is minimized and often localized to an area of the tower section that will be part of a joint between tower sections and thus, less noticeable. In additional scenarios similar to that shown in FIG. 12, the flange may contact the front surface 14, the locking pin 80, the shaft 46, the retention barrier 44 or a combination of those crane hook assembly 10 elements. The points at which the tower section 110 is engaged by the crane hook assembly 10 will depend on the shape of the flange, the placement of the flange and the angle at which the tower section is tilted. Without the securing mechanism 60 of the present invention, the operators O, O' and could be at risk. Although the flange 116*b* extending inwardly, it will be understood that the crane hook assembly 10 of FIG. 12 can be modified to accommodate and retain tower sections 110 having flanges similar to the annular flange 116*a* of FIGS. 9 and 11.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A crane hook assembly attachable to a crane cable and useable for safely carrying a heavy, hollow, elongated structure, the elongated structure having first and second end orifices and a rigid outer wall extending therebetween, the structure including a rigid flange adjacent at least one end orifice, the flange having an outer surface, an inner surface and an edge surface and the flange extending inwardly from the outer wall and adjacent the end orifice, the crane hook assembly comprising:

a rigid frame member attachable to the crane cable and having front and rear faces, the front face having a generally flat portion oriented in a generally upright plane when the frame member is attached to and suspended from the cable, the frame member further including a rigid support member having an upward facing entry zone to receive the flange from above the support member when the frame member is lifted upward to engage the flange, the support member constructed and arranged to support the edge surface of the flange and to cooperate with the front face to generally confine the outer and inner surfaces of the flange;

a securing mechanism mounted to the frame member and including a moveably mounted rigid locking pin selectively moveable along a path between a storage position clear of the entry zone, so as to allow unobstructed engaging and disengaging of the flange with the support member, and a locked position, wherein in the locked position the locking pin is above and closely adjacent the flange when the flange edge surface is supported on the support member and the locking pin substantially obstructing the entry zone, thereby preventing the support member from accidentally disengaging from the flange and the crane hook assembly separating from the elongated structure; and wherein the frame member includes a locking pin aperture extending between front and rear faces of the frame member, the securing mechanism includes an actuation device for moving the locking pin, the actuation device being fixed to the rear face of the frame member for convenient access by an operator from below the hook assembly and the locking pin being aligned for movement through the locking pin aperture.

2. The crane hook assembly of claim 1, the actuation device including a rack and pinion gear system connected with the locking pin to move the locking pin between storage and locked positions.

3. The crane hook assembly of claim 2, the securing mechanism including a downwardly extending actuator shaft, wherein rotation of the shaft operates the rack and pinion gear system to move the locking pin between storage and locked positions, the crane hook assembly further including an elongated wrench having a length adequate to extend from the actuator shaft to the operator so as to allow rotation of the wrench by the operator on the ground when the frame member is out of unassisted reach of the operator.

4. The crane hook assembly of claim 3, the elongated wrench further including a funnel guide that provides quick alignment of the wrench with the actuator shaft by the operator when the frame member is out of reach of the operator.

5. The crane hook assembly of claim 1, the actuation device further including a rotatable actuator shaft oriented generally vertically when the frame member is suspended from the crane cable, the rotatable actuator shaft extending downwardly from the actuation device so as to be visible and accessible to an operator standing on the ground below the crane hook assembly.

6. The crane hook assembly of claim 1, the path being substantially perpendicular to the front face of the frame member and above the flange of the carried elongated structure.

7. The crane hook assembly of claim 1, the support member including a rigid base extending outwardly from the front face and further including a retention barrier extending upwardly from the base, the entry zone of the support member extending upwardly between the front face and the retention barrier and upwardly from the support member to a location above the path.

8. The crane hook assembly of claim 7, the locking pin, when in the locked position, extending from the front face to at least the retention barrier.

9. The unloading hook of claim 8, the locking pin, when in the storage position, being located wholly outside the entry zone so as to allow free ingress and egress of the flange into and out of the support member.

10. A crane hook assembly attachable to a crane cable and useable for safely carrying a heavy, hollow, elongated structure having a decorative outer surface and non-decorative surfaces without damaging the decorative surface, the elongated structure having first and second end orifices and a rigid wall extending therebetween, the structure including a rigid flange extending inwardly from the wall at each end orifice for a predetermined distance and having a predetermined thickness, the inwardly extending flange forming no part of the decorative outer surface, the crane hook assembly comprising:

a rigid, generally upright frame member attachable to the crane cable and having front and rear faces;

a rigid support member attached to the front face of the frame member, the support member being smaller than one of the end orifices of the elongated structure and extending outwardly from the frame member and insertable within one of the end orifices;

the rigid support member including a base extending outwardly from the front face of the frame member and further including a retention barrier attached to the base and extending upwardly from the base, the retention barrier spaced a first distance from the front face;

the first distance exceeding the predetermined thickness of the flange;

the retention barrier extending upwardly from the base a distance less than the predetermined distance of the flange;

the front face of the frame member extending above the support member, the front face being generally flat and cooperating with the base and retention barrier to define an unobstructed entry zone adjoining the front face of the frame member and directly above the base wherein the entry zone is insertable within one of the end orifices by placing the front face against the end orifice so that raising the frame member causes the base to engage non-decorative surfaces of the flange without engaging the decorative outer surface of the elongated structure; and a securing mechanism attached to the rear face of the frame member and including a locking pin moveable between a storage position outside the entry zone and a locked position, wherein the locking pin extends outwardly from the frame member and extends forwardly from the front face through the entry zone to closely overlie the flange when the flange contacts the base to thereby trap the flange within the support member and prevent accidental dislodgement of the elongated structure from the hook assembly;

wherein the frame member includes a locking pin aperture extending between front and rear faces of the frame member, the securing mechanism includes an actuation device for moving the locking pin between storage and locked positions, the actuation device being fixed to the rear face of the frame member for convenient access by an operator from below the hook assembly and the locking pin being positioned for movement along the locking pin aperture.

11. The crane hook assembly of claim 10, wherein the locking pin is oriented perpendicularly to the front face.

12. The crane hook assembly of claim 10, wherein the actuation device includes a rack and pinion gear connected with the locking pin to move the locking pin between storage and locked positions.

13. The crane hook assembly of claim 12, wherein the securing mechanism includes a downwardly extending actuator shaft, wherein rotation of the shaft operates the rack and pinion gear to move the locking pin between storage and locked positions, the crane hook assembly further including an elongated wrench having a length adequate to extend from the actuator shaft to the operator so as to allow rotation of the crank by the operator when the frame member is out of reach of the operator.

14. The crane hook assembly of claim 12, wherein the locking pin, when in the locked position, extends from the front face for a distance substantially the same as the distance between the front face and the retention barrier.

15. The crane hook assembly of claim 10, wherein, the locking pin, when in the locked position, extends from the front face for a distance substantially the same as the distance between the front face and at least the retention barrier.

16. A method of engaging a crane hook assembly to a rigid, elongated, hollow structure to safely raise and lower the structure without damage to a decorative surface of the structure, the method comprising the steps of:

providing a crane with a lifting cable;

providing a rigid, elongated, hollow structure having first and second end orifices and a rigid wall extending therebetween, the structure further including at least one adjacent end orifice including a flange having an inner surface, an outer surface and an edge surface, and the flange extending inwardly from the wall and adjacent the end orifice;

providing a crane hook assembly including:

a rigid frame member having:

front and rear faces, the front face having a generally flat portion oriented in an upright plane when the frame member is attached to and suspended from the cable, a rigid support member having an upward facing entry zone to receive the flange from above the support member when the frame member is lifted upward to engage the flange, the support member constructed and arranged to support the edge surface of the flange and to confine the outer and inner surfaces of the flange; and a securing mechanism mounted to the frame member and including a moveably mounted rigid locking pin selectively moveable along a path between a storage position clear of the entry zone, so as to allow unobstructed entry of the flange into the support member and unobstructed withdrawal of the flange from the support member, and a locked position, wherein the locking pin is above and closely adjacent the flange when the flange edge surface is supported on the support member;

raising the crane hook assembly to engage the support member with the flange; and positioning the locking pin in the locked position such that the support member is prevented from accidentally disengaging from the flange and the crane hook assembly is prevented from separating from the elongated structure.

17. A method of safely engaging a crane hook assembly to a rigid, elongated, hollow structure, the elongated structure having first and second end orifices and a rigid outer wall extending therebetween, the structure including a rigid flange adjacent to at least one end orifice, the flange having outer, inner and edge surfaces and extending inwardly from the outer wall of the orifice for a first distance, the flange having a predetermined thickness, the method comprising the steps of:

providing a crane hook assembly including a rigid frame member having front and rear faces, the front face having a generally flat portion and a support member including a base and a retention barrier;

moving the crane hook assembly with a crane to an end orifice of the elongated structure;

moving the crane hook assembly with the crane to a height at which the support member confronts the end orifice;

aligning the crane hook assembly with the structure by placing the flat portion of the frame member against the outer surface of the flange with the support member extending into the end orifice below the edge surface of the flange;

raising the crane hook assembly with the crane until the edge surface of the flange is supported on the base with the outer and inner surfaces of the flange closely confronting the flat portion of the crane hook assembly and the retention barrier, respectively; and moving a locking pin from a storage position located on the rear face of the frame member and along a path extending outwardly from the front face and into a locked position which closely overlies the support member to assure that the hook assembly cannot be accidentally detached from the elongated structure.

18. The method of claim 17, and further including the step of moving the locking pin by a rack and pinion gear system.

19. The method of claim 18, and further including the steps of providing the rack and pinion gear system with a downwardly extending actuator shaft; and rotating the actuator shaft to energize the rack and pinion gear to move the locking pin along the path.

20. The method of claim 19, and further including the step of connecting an elongated wrench with the actuator shaft, the wrench extending downwardly from the actuator shaft and accessible to an operator.

21. The method of claim 20, and further including the step of using a funnel guide on the elongated wrench so as to more quickly and positively engage the actuator shaft.

22. The method of claim 17, and further including the step of providing a rigid, elongated, hollow structure including providing a wind generator tower section.

23. The method of claim 17, and further including the step of moving the locking pin until the locking pin is at least partially over the retention barrier.

24. A crane hook assembly attachable to a crane cable and useable for safely carrying a heavy, hollow, elongated structure, the elongated structure having first and second end orifices and a rigid outer wall extending therebetween, the structure including a rigid flange adjacent at least one end orifice, the flange having an outer surface, an inner surface and an edge surface and the flange extending inwardly from the outer wall and adjacent the end orifice, the crane hook assembly comprising:

a rigid frame member attachable to the crane cable and having front and rear faces, the front face having a generally flat portion, the front face and the rear face having an upright orientation when the frame member is attached to and suspended from the cable, the frame member further including a rigid support member having an upward facing entry zone, at least partially defined by the flat portion, to receive the flange from above the support member when the frame member is lifted upward to engage the flange, the support member constructed and arranged to support the edge surface of the flange and to cooperate with the front face to confine the outer and inner surfaces of the flange; the support member further including a rigid base extending outwardly from the front face and further including a retention barrier extending upwardly from the base, the entry zone of the support member extending upwardly between the front face and the retention barrier; and a securing mechanism mounted to the frame member and including a moveably mounted rigid locking pin selectively moveable outwardly from the front face along a path between a storage position clear of the entry zone, the entry zone extending upward without any overhead obstruction, when the locking pin is in the storage position so as to allow unobstructed vertical engaging and disengaging of the flange with the support member, and a locked position, wherein when in the locked position the locking pin is above and closely adjacent the flange when the flange edge surface is supported on the support member and the locking pin is substantially obstructing the entry zone, thereby preventing the support member from accidentally disengaging from the flange and the crane hook assembly separating from the elongated structure;

the path of the locking pin being above the retention barrier.

25. The crane hook assembly of claim 24, wherein the rigid base is constructed and arranged to allow the crane hook assembly to be supported in a stable, non-tipping, upright condition when placed on a generally flat foundation.

26. The crane hook assembly of claim 24, wherein the frame member includes a locking pin aperture extending between front and rear faces of the frame member, the securing mechanism includes an actuation device for moving the locking pin, the actuation device being fixed to the rear face of the frame member for convenient access by an operator from below the hook assembly and the locking pin being aligned for movement through the locking pin aperture.

27. The crane hook assembly of claim 26, wherein the securing mechanism includes a downwardly extending actuator shaft, wherein rotation of the shaft operates a rack and pinion gear to move the locking pin between storage and locked positions, the crane hook assembly further including an elongated wrench having a length adequate to extend from the actuator shaft to the operator so as to allow rotation of a crank by the operator when the frame member is out of reach of the operator.

28. The crane hook assembly of claim 24, wherein the locking pin, when in the storage position, being located wholly outside the entry zone so as to allow free ingress and egress of the flange into and out of the support member and when in a locked position being in a non-contact relationship with the elongated structure when the structure is lifted by the support member.

* * * * *